US005218271A

United States Patent [19]

Egorov et al.

[11] Patent Number: 5,218,271

[45] Date of Patent: Jun. 8, 1993

[54] PLASMA ACCELERATOR WITH CLOSED ELECTRON DRIFT

[75] Inventors: Vitaly V. Egorov; Vladimir M. Gavrushin; Vladimir Kim, all of Moscow; Vyacheslav I. Kozlov, Tarusa; Leonid A. Latyshev; Sergey A. Khartov, both of Moscow, all of U.S.S.R.

[73] Assignee: Research Institute of Applied Mechanics and Electrodynamics of Moscow Aviation Institute, Moscow, U.S.S.R.

[21] Appl. No.: 718,712

[22] Filed: Jun. 21, 1991

[30] Foreign Application Priority Data

Jun. 22, 1990 [SU] U.S.S.R. ..... 4841410

[51] Int. Cl.[5] ..... H05M 1/54

[52] U.S. Cl. ..... 315/111.61; 315/111.21; 315/111.41; 313/231.31

[58] Field of Search ..... 315/111.11, 111.21, 315/111.41, 111.61; 313/231.31

[56] References Cited

U.S. PATENT DOCUMENTS

| | | | |
|---|---|---|---|
| 4,721,889 | 1/1988 | Seidel et al. | 315/111.41 X |
| 4,862,032 | 8/1989 | Kaufman et al. | 315/111.41 X |
| 4,980,610 | 12/1990 | Varga | 315/111.41 X |
| 5,006,760 | 4/1991 | Drake, Jr. | 315/111.21 |

*Primary Examiner*—Eugene R. LaRoche
*Assistant Examiner*—Do Hyun Yoo
*Attorney, Agent, or Firm*—Townsend and Townsend, Khourie and Crew

[57] ABSTRACT

A plasma accelerator with closed electron drift includes a magnetic system (4), a cathode (10), and a discharge chamber with an annular acceleration passage (3) accommodating a hollow anode (7) communicating therewith by way of at least one outlet passage (8). The outlet passage (8) is curved, and a straight line drawn from any interior of anode (7) to any point in the acceleration passage (3) intersects walls of anode (7).

5 Claims, 6 Drawing Sheets

PLASMA ACCELERATOR WITH CLOSED ELECTRON DRIFT

FIELD OF THE INVENTION

This invention relates generally to plasma technology, and more particularly concerns a plasma accelerator with closed electron drift.

The invention can find application for designing production process sources of accelerated ion flows and other devices based on the use of accelerators with closed electron drift intended to machine workpieces in a vacuum.

BACKGROUND OF THE INVENTION

There are known plasma accelerators with closed electron drift (cf., "Plazmennye uskoriteli" edited by L. A. Artsimovich, 1973, The Mashinostroenie Publishers, Moscow, pages 5 to 25) comprising a discharge chamber accommodating an anode with gas distribution cavities, a magnetic system for generating in the interior of the discharge chamber a magnetic field with the lines of force thereof being transverse to the flow of gas therein at a first approximation. Provided outside the interior of the discharge chamber in proximity to its outlet section is a cathode. These accelerators can ionize and accelerate ions of various substances, and have found wide industrial application.

There is known a plasma accelerator with closed electron drift (cf., L. A. Artsimovich "Razrabotka statsionarnogo plazmennogo dvigatelya i ego ispytanie na iskusstvennom sputnike Zemli "Meteor", Kosmicheskie issledovania, 1974, issue 3, pages 451 to 459). This plasma accelerator comprises a discharge chamber with a housing including coaxial inner and outer cylindrical elements defining an annular acceleration passage open at the side of the outlet section of the discharge chamber. The acceleration passage accommodates a hollow anode communicating with a gas feeding system through at least one inlet passage and with the accelerating passage by way of outlet passages. The accelerator also comprises a magnetic system with pole pieces of which one embraces the outer cylindrical element and the other is positioned in the inner cylindrical element, and a cathode located outside the interior of the discharge chamber near to its outlet section.

These known accelerators operate efficiently on a range of easy-to-ionize gases with a relatively low ratio of ionization potential $\phi_i$ to the mass M of ions at substantially high flow rates of the working gas. Such working gases include primarily vapours of alkali metals or for example, xenon. However, when operating on xenon at low flow rates of gas, as well as when operating on argon, nitrogen, oxygen and other gases, the performance of the accelerator is low because of difficulties associated with meeting a major condition for efficient operation, viz.:

$$\lambda_u \leqq L_k, \tag{1}$$

where $\lambda_u$ is the free travel path of atoms prior to ionization, and $L_k$ is the length of the discharge chamber as measured from the anode to its outlet section.

In addition, efficiency is further lowered due to a jump in anodic potential caused by reduced concentration of plasma in the entire passage and reduction in the magnitude of electron flow $N_e$ to the anode due to thermal motion ($N_e = \frac{1}{4} n_e v_e$, where $n_e$ is the concentration and $v_e$ is the thermal velocity of electrons). An increase in the anodic potential jump $\phi_a$ leads, in particular, to contraction of the discharge whereby it tends to penetrate to the outlet passages of the anode and to the interior of the anode. Ions generated inside these passages are neutralized at the walls of the anode, and therefore the amount of energy expended for ionizing the gas in the discharge chamber is increased.

SUMMARY OF THE INVENTION

The present invention aims at providing a plasma accelerator with closed drift of electrons having outlet passages of the anode so constructed as to prevent contraction of the discharge and expand the surface area of the anode portion onto which electrons escaping from the discharge plasma fall, which would lead to reduced anodic potential jump and losses for ionization due to fewer number of ions neutralized at the inner surfaces of the walls of the anode.

The aim of the invention is attained by that in a plasma accelerator with closed electron drift comprising a discharge chamber with an annular acceleration passage open at the side of the outlet section of the discharge chamber, a hollow anode positioned in the acceleration passage and communicated therewith by way of at least one outlet passage and with the gas feeding system by way of at least one inlet passage, a magnetic system for inducing a magnetic field in the acceleration passage, and a cathode located outside the discharge chamber in close proximity to its outlet section, according to the invention, the outlet passage is curved, and a straight line drawn from any point of the anode interior to any point of the acceleration passage crosses at least once the walls of the anode.

It is advantageous that the anode be provided with at least one baffle plate positioned in the acceleration passage with a clearance to the wall of the anode, the anode and baffle plate being preferably arranged so that flat parallel portions would be provided at the surfaces of their walls facing each other, whereas the outlet passage would be defined by said clearance between the anode and baffle plate and hole in the wall of the anode at its flat portion, the minimum distance $\Delta r$ from the axis of the hole perpendicular to the surface of the flat portion of the anode wall to the edge of the flat portion of the baffle plate wall, and the distance $\delta$ between the flat portions of the walls of the anode and baffle plate would meet the relationship:

$$\Delta r = d\,\frac{\delta_1 + \frac{\delta_2}{2}}{\delta_2}, \tag{2}$$

where d is the diameter of the hole, and $\delta_2$ is the thickness of the anode wall at the point of location of the hole.

When meeting the above relationship between dimensions, a straight line drawn from any point in the interior of the anode to any point of the acceleration passage intersects the body of the baffle plate. In addition, making the inlet portion of the outlet passage in the form of holes offers most simple structural materialization of the anode.

The aim of the invention is attained also by that in a plasma accelerator with closed electron drift comprising a discharge chamber with an annular acceleration passage open at the side of the outlet section of the discharge chamber, a hollow anode positioned in the acceleration passage and communicating therewith by way of at least one outlet passage, whereas communicating with the gas feeding system by way of at least one inlet passage, a magnetic system for inducing a magnetic field in the acceleration passage, and a cathode located outside the discharge chamber in the immediate proximity to its outlet section, according to the invention, the anode is provided with at least one baffle plate secured in the acceleration passage of the discharge chamber in the immediate proximity to the wall of the anode facing the outlet section of the discharge chamber, whereas the outlet passage is provided in the opposite wall of the anode, the shortest distance from the walls of the acceleration passage to the surfaces of the baffle plates facing toward these walls being smaller than the shortest distance from the walls of the acceleration passage to the walls of the anode.

This arrangement of the anode makes it possible to attain a more uniform gas distribution cross sectionally of the acceleration passage of the discharge chamber by providing an additional gas distribution cavity between the baffle plate and wall of the discharge chamber opposite to its outlet section, as well as to substantially simplify the anode structurally, which is especially important when the acceleration passage has an intricate configuration, such as when it is elongated in one of the directions.

The proposed plasma accelerator with closed electron drift can be provided with at least one membrane positioned after the cathode and arranged so that a straight line drawn from any point of the surface of the baffle plate facing the outlet section of the discharge chamber, and/or from any point of the clearance between the baffle plate and anode to any point at the surface of the membrane facing the discharge chamber intersects the outer wall of the acceleration passage of the discharge chamber.

When using an accelerator in apparatus for ion-plasma machining workpiece surfaces, the membrane allows to limit the machining zone and reduce the flow of impurities formed by sputtering the material of the walls of the vacuum chamber where the workpiece is machined, as well as impurities entering the machining zone as a result of sputtering and evaporation of the materials making up the accelerator per se. In addition, the membrane embodied according to the invention makes it possible to obviate contamination of the baffle plate surface with products of sputtering of the material of the membrane by an ion beam.

BRIEF DESCRIPTION OF THE DRAWINGS

The invention will be more fully understood from a more detailed description of a preferred embodiment thereof taken in conjunction with the accompanying drawings, in which.

DETAILED DESCRIPTION OF A PREFERRED EMBODIMENT

Figure 1:
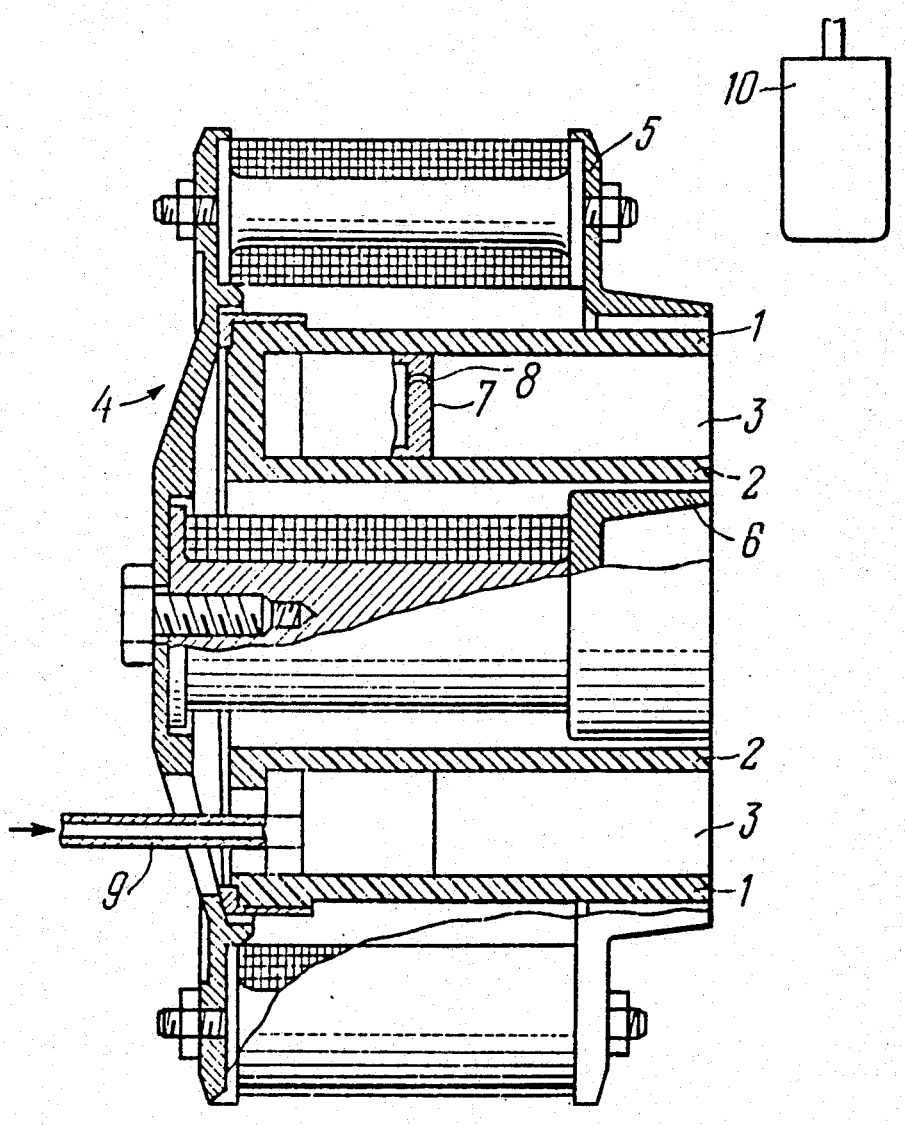
FIG. 1 is a structural diagram of a plasma accelerator with closed electron drift according to the invention.

With reference to FIG. 1, a plasma accelerator with closed electron drift according to the invention comprises a discharge chamber whose housing is defined by coaxial outer and inner cylindrical elements 1 and 2 confining an acceleration passage 3 of the discharge chamber, and a magnetic system 4 with pole pieces 5 and 6. The pole piece 5 embraces the outer cylindrical element 1, whereas the pole piece 6 is secured in the inner cylindrical element 2. The acceleration passage 3 of the discharge chamber accommodates a hollow anode 7 communicating therewith by way of outlet passages 8, and communicating with a gas feeding system (not shown) by way of at least one inlet passage 9. Each outlet passage 8 is curved, and can have a different configuration. Positioned outside the discharge chamber in proximity to its outlet section is a cathode 10.

Figure 2:
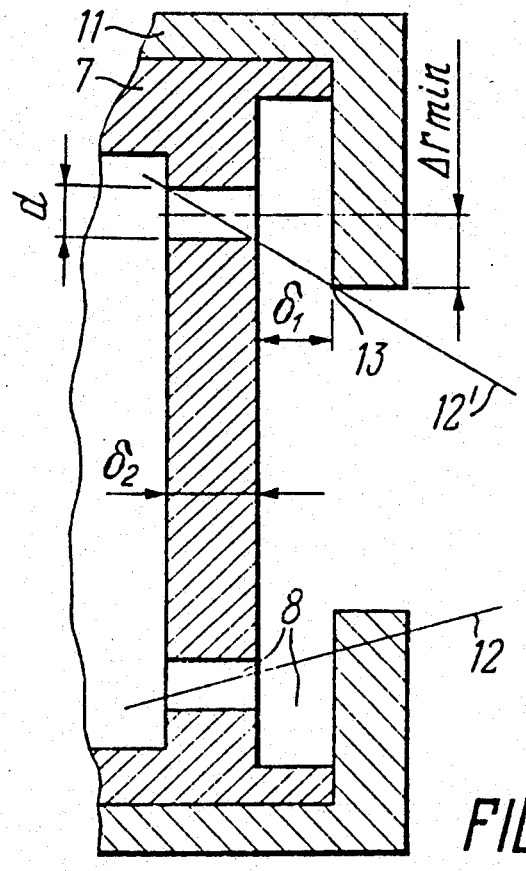
FIG. 2 shows part of anode facing the outlet section of a discharge chamber with flat baffle plates.

The curved configuration of the passage 8 can be attained by providing the anode 7 (FIG. 2) with baffle plates 11 positioned in the acceleration passage 3 (FIG. 1) with a clearance relative to the wall of the anode 7 (FIG. 2). The number of baffle plates 11 can be different, and depends on the location and number of groups of outlet passages 8. In this case the outlet passage 8 is defined by a hole made in the wall of the anode 7 at its flat portion and a clearance between the anode 7 and baffle plate 11. For the herein proposed construction the preferred relationship is:

$$\Delta r \geqq d\,\frac{\delta_1 + \frac{\delta_2}{2}}{\delta_2}, \qquad (2)'$$

where $\delta_2$ is the thickness of flat portion of the wall of anode 7;

$\Delta r$ is the minimum distance from the axis of the hole to edge 13 of flat portion of the surface of baffle plate 11;

$\delta$ is the clearance between flat portions of the surface of anode 7 and baffle plate 11 facing each other; and d is the diameter of hole in the wall of anode 7.

When meeting this relationship, a straight line 12 drawn from the interior of the anode 7 toward the interior of the acceleration passage 3 (FIG. 1) intersects the flat surface of baffle plate 11 facing toward the anode 7. This intersection will take place if the edge 13 is sufficiently remote from the axis of the hole. The minimum magnitude of $\Delta r$ here will correspond to a condition when straight line 12' is brought in contact with the edge 13. When $\Delta r > \Delta r_{min}$, the straight line 12' drawn from the interior of anode 7 intersects the body of the baffle plate 11.

Figure 3:
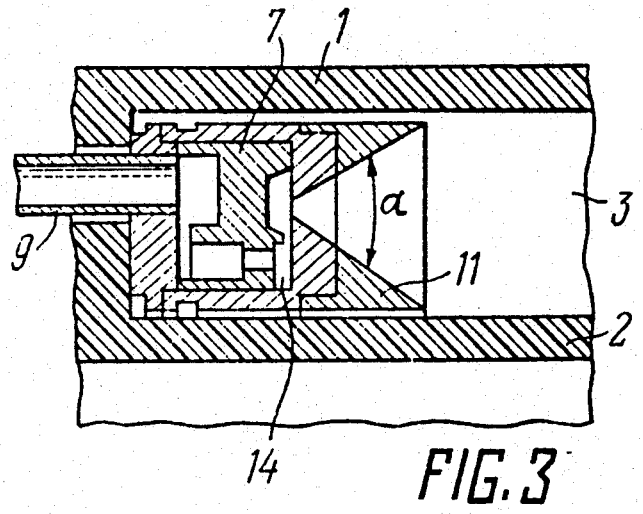
FIG. 3 shows a modification of the anode with sectional baffle plates.

The baffle plate 11 (FIG. 3) can be sectional to define an additional gas distribution cavity 14 between the anode 7 and baffle plate 11, and can be fabricated from various materials and with different flare angle $\alpha$ of the outlet portion of the anode 7.

Figure 4:
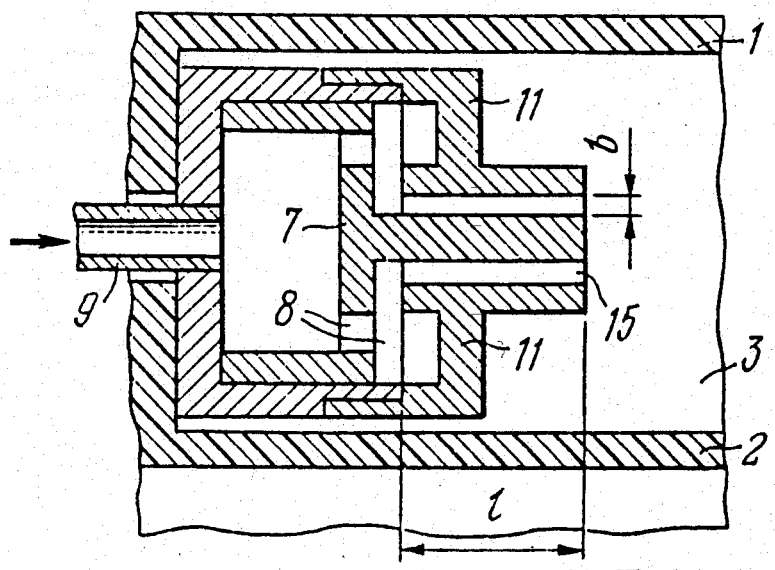
FIG. 4 is a modified form in which baffle plates have elongated coaxial cylindrical surfaces defining slotted passages wherethrough the gas escapes.

The baffle plates 11 (FIG. 4) can be coaxial with the elongated cylindrical surfaces defining slotted passages 15 wherethrough the gas escapes. Therewith, it is advisable to follow the condition of $l > b$, where l is the length of the cylindrical surface of the baffle plate 11, and b is the clearance between the surface of baffle plate 11 and cylindrical surface of anode 7 positioned in front of it.

Figure 5:
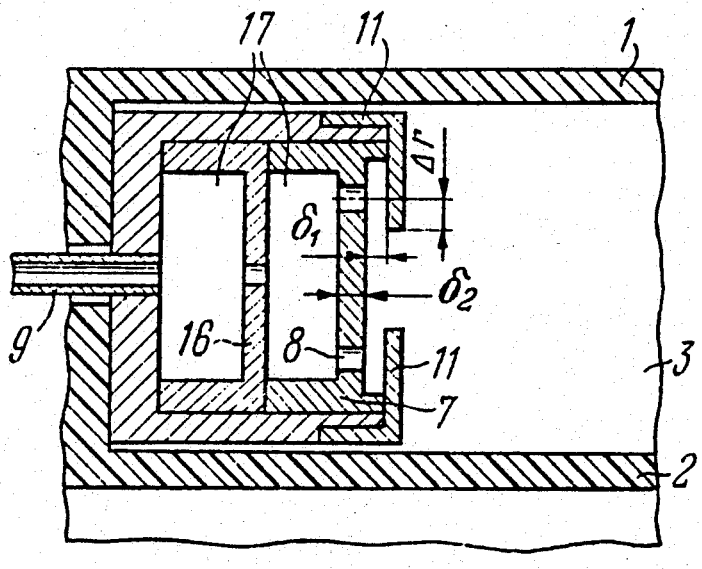
FIG. 5 shows a modified construction of the anode with a partition.

An alternative modification of the anode 7 is represented in FIG. 5, where it has a partition 16 dividing the interior of the anode 7 into two successive gas distribution chambers 17.

Figure 6:
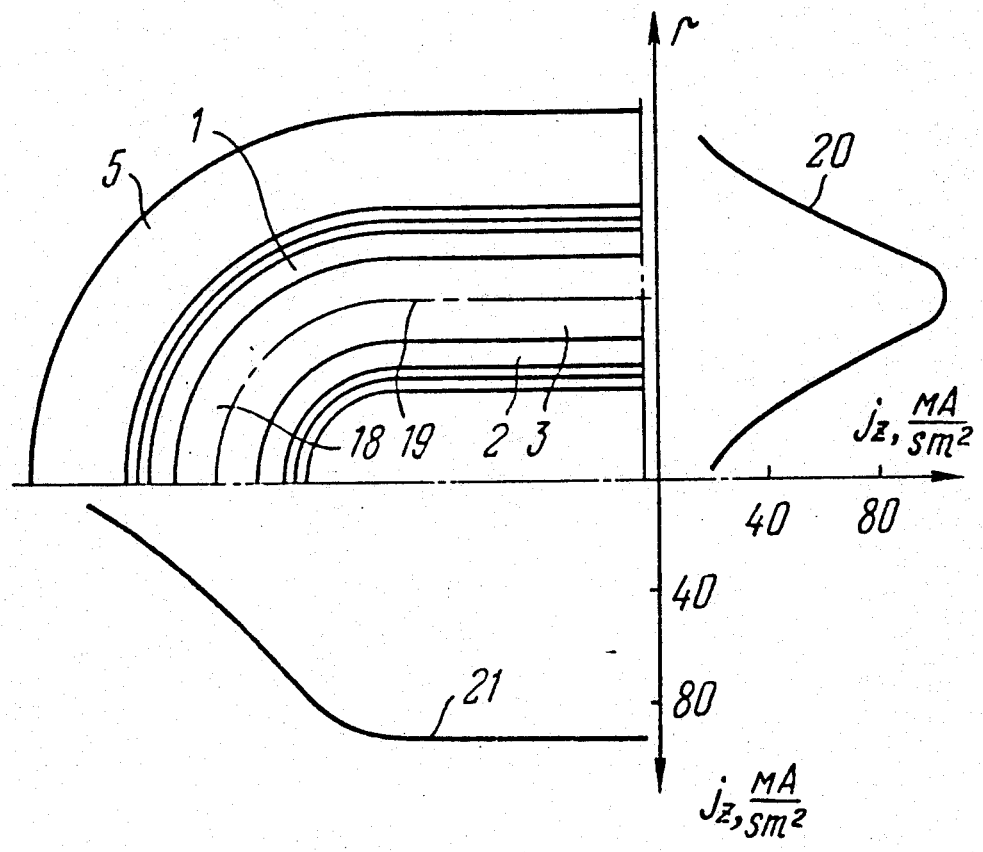
FIG. 6 illustrates an alternative embodiment of the discharge chamber with an elongated acceleration passage.

The acceleration passage 3 (FIG. 6) can be elongated, for example, in a plane perpendicular to the axis of the accelerator, and can be made up of two semicircular portions 18 and two rectilinear portions 19. FIG. 6 also shows curves 20 and 21 representing distribution of the axial density of ion current $j_z$ in a plane perpendicular to the axis of the discharge chamber in proximity to its outlet section. Curve 20 corresponds to the axial density of ion current $j_z$ in a plane perpendicular to the rectilinear portion 19 of the acceleration passage 3, whereas curve 21 shows distribution of the axial density of ion current $j_z$ in a plane parallel to the rectilinear portions 19. In this case the anode 7 (FIG. 7) is preferably tubular with a flat baffle plate 11 secured at the side of the outlet section of the discharge chamber and having outlet passages 8 made in the wall of the anode 7 at the opposite side to define an additional gas distribution cavity 22. The shortest distance $\delta$ from the walls of acceleration passage 3 to the surfaces of baffle plate 11 facing thereto is smaller than distances s from the walls of the acceleration passage 3 to the walls of anode 7.

It is further possible to use anode 7 (FIG. 8) with two groups of outlet passages 8 in its wall at the side opposite to the outlet section of the discharge chamber, or anode 7 (FIG. 9) with a baffle plate 11 insulated therefrom by a dielectric insert 23. The constructions of anode 7 illustrated in FIGS. 7, 8 and 9 also envisage the provision of additional gas distribution cavity 22, and for ensuring highly uniform gas distribution it is advisable to follow the condition $\delta < s$.

Figure 10:
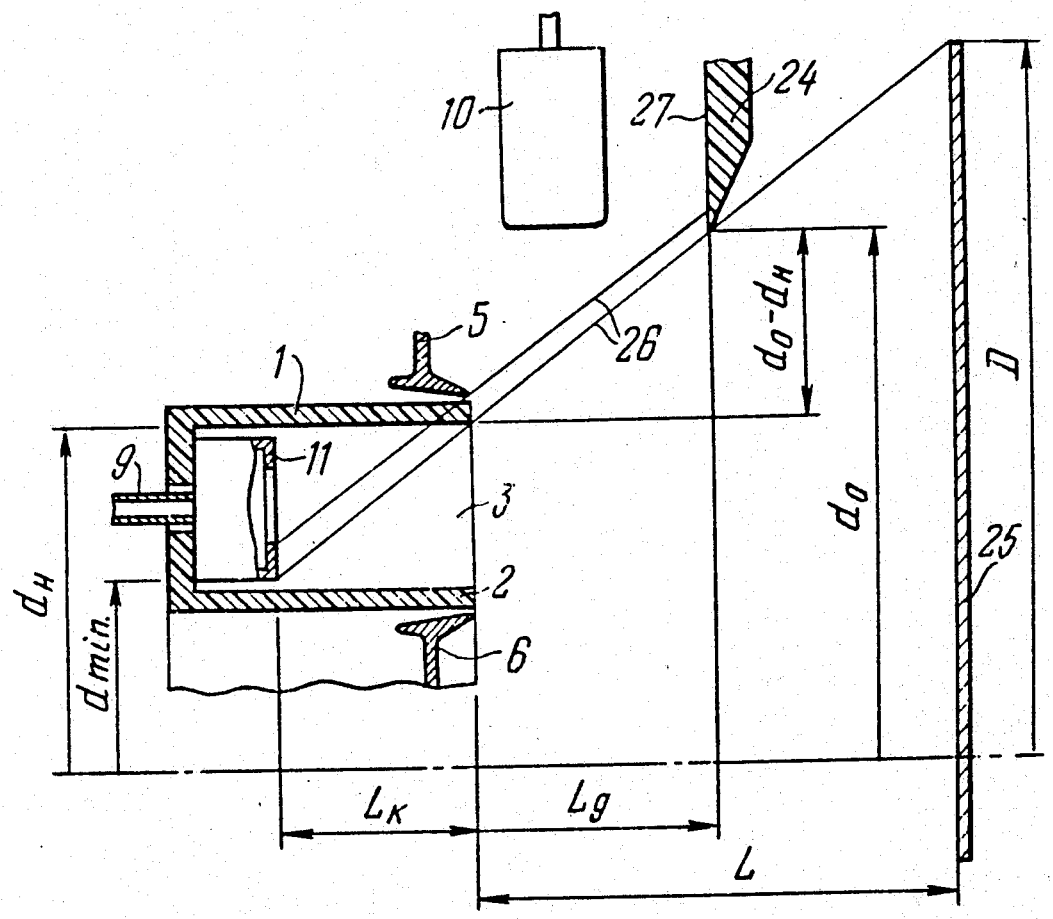
FIG. 10 shows schematically positioning of the membrane.

Referring now to FIG. 10, the proposed plasma accelerator can have a membrane 24 with a hole positioned between the cathode 10 and machining zone 25, a straight line 26 drawn from any point at the surface 27 of membrane 24 facing the discharge chamber to any point at the surface of the baffle plate 11 facing the outlet section of the discharge chamber intersecting the body of the cylindrical element 1 functioning as the outer wall of the acceleration passage 3. Therewith, preselected accordingly is the relationship between dimensions of the acceleration passage 3 of the discharge chamber, hole in the membrane 24, and distance from the membrane 24 to the outlet section of the acceleration passage 3. In a simplest case, when the walls of the discharge chamber are defined by the cylindrical elements 1 and 2, the diameter $d_o$ of the hole in membrane 24 meets the following relationship:

$$d_o - d_H = L_g / L_k (d_H - d_{min}), \tag{3}$$

where $d_H$ is the inside diameter of the outer cylindrical element 1;

$d_{min}$ is the minimum diameter of the elements of baffle plates 11 facing toward the outlet sections of the discharge chamber;

$L_g$ is the distance from the outlet section of the discharge chamber to the section of the membrane 24 of the minimum diameter; and $L_k$ is the distance from the baffle plates 11 to the outlet section of the discharge chamber.

Here, the maximum diameter D of machining zone 25 is determined by the distance L from the outlet section of the discharge chamber to this zone 25 according to the relationship:

$$D = d_H + L \frac{d_o - d_H}{L_g}. \tag{4}$$

The proposed plasma accelerator with closed electron drift operates in the following manner.

A discharge voltage $U_p$ of 100–1000 V is applied between anode 7 (FIG. 1) and cathode 10. A voltage is also applied to the coils of magnetic system 4, if the latter has electromagnets (permanent magnets can alternatively be used). Characteristic magnitudes of magnetic induction in the acceleration passage 3 amount to 0.01–0.05 Tl. The cathode 10 is then prepared to operation (if necessary, it is heated, and gas is admitted thereto if it is a gas-discharge cathode). Gas is then fed to the gas distribution cavities of the anode 7. A discharge is initiated in the accelerator by actuating the cathode 10 (such as by initiating a gas discharge if it is a gas discharge cathode). Initiation of a main discharge in the accelerator between anode 7 and cathode 10 causes ionization of the gas conveyed through the anode 7 to the acceleration passage 3, and acceleration of ions in the discharge glowing in the crossing electric (longitudinal) and magnetic (transverse) fields. Operating conditions of the accelerator (flow rate of gas and magnitude of magnetic induction) are preselected so as to ensure efficient ionization of gas and acceleration of ions to an energy $(0.5 \div 0.9)\, eU_p$, where e is the charge of the electron. Accelerated ions act to capture from the cathode 10 a sufficient quantity of electrons to compensate for its volume charge. Therefore, by varying $U_p$ it is possible also to change the energy of ions in the accelerated plasma flow. When operating on low flow rates of gas, or when using hard-to-ionize gases, it is impossible to attain a highly efficient ionization. The reason for the failure to attain high efficiency of ionization resides in that the length of free travel path of atoms prior to ionization is:

$$\lambda_u = \frac{V_a}{\langle \sigma_u \cdot V_e \rangle n_e}, \tag{5}$$

where $V_a$ is the mean longitudinal velocity of atoms;

$\langle \delta_u V_e \rangle$ is the coefficient of ionization velocity averaged in terms of the function of distributing electrons on velocities $V_e$ ($\delta_u$ is the ionization cross-section);

$n_e$ is the average concentration of electrons in the discharge chamber.

When using argon, nitrogen or oxygen, the magnitudes of $\lambda_u$ with comparable energies of electrons and ions are several times greater, while the magnitudes of $<\delta_u V_e>$ and $n_e$ are at least several times smaller than when using xenon. In consequence, the aforementioned conditions (1) can be fulfilled only by increasing the magnitude of $n_e$, which primarily depends on the flow density or ion current density, and at a fixed energy—on the power of discharge. However, opportunities toward their increase are limited. Therefore, when operating on such gases, the likelihood of ionization of gas atoms in the discharge chamber is low. The situation is similar even when using xenon at low flow density and discharge voltages, and when the energy of electrons is insufficient for efficient ionization. Experiments have shown that under such conditions, as distinct from highly efficient ionization, the process is accompanied by a positive drop in the anodic plasma potential, contraction of discharge in the outlet passages 8 of anode 7, and intensive oscillations in the discharge circuit whereby the discharge penetrates through the outlet passages 8 to the interior of the anode 7. Neutralization of ions formed in the interior of the anode 7 on the walls leads to the consumption of more energy and to a reduction in the efficiency of the accelerator.

The herein proposed technical solutions make it possible to increase the efficiency of ionization and reduce the aforementioned losses. The baffle plates 11 shown in FIGS. 3, 4, 5, 7, 8 and 9 are so constructed as to prevent penetration of discharge to the interior of the anode and its contraction in the outlet passages 8 of the anode 7 by virtue of recombination of ions as the plasma moves along narrow clearances between the surfaces of the baffle plates 11 and anode 7.

In addition, the anodes 7 shown in FIGS. 2 and 5 are capable of substantially reducing the longitudinal velocity of the working gas atoms through deviating their path by the baffle plates 11 and converting the longitudinal velocity into radial. In this case atoms leave the discharge chamber only after repeated collisions with its walls, which according to the relationship (5) reduces the length of ionization path $\lambda_u$ and makes atoms of the working gas more susceptible to ionization.

The magnitude $\Delta r$ is preset in accordance with the relationship (2) for preventing the penetration of ions directly to the outlet passages 8 of anode 7 and making the direct escape of the atoms of working gas impossible. The use of anode 7 with baffle plates 11 ensures a higher efficiency of the accelerator operating under conditions when ionization rate is lowered by 10 . . . 15% at a general efficiency level of 20 . . . 45% within a range of accelerating voltages 100 . . . 500 V.

In view of the aforedescribed, the invention allows to increase the efficiency of the accelerator.

Figure 7:
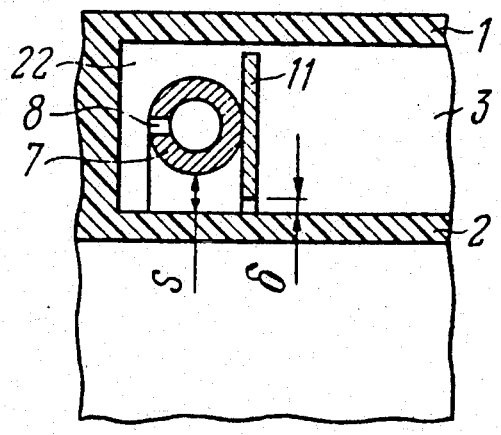
FIG. 7 shows a modified form of the anode with baffles positioned at the side of the outlet section of the discharge chamber and having outlet passages provided at the opposite wall of the anode.
Figure 8:
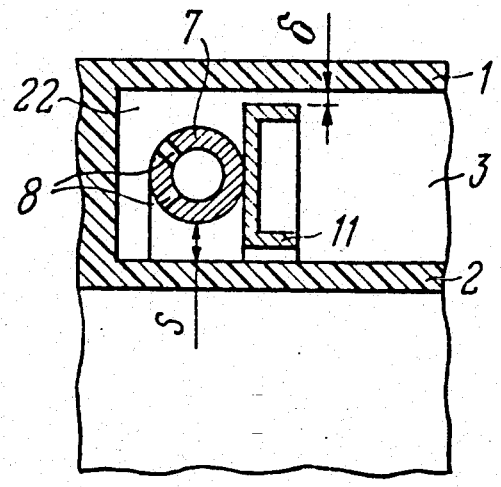
FIG. 8 is a modification of the anode with two systems of outlet passages in the wall of the anode opposite to the outlet section of the discharge chamber.
Figure 9:
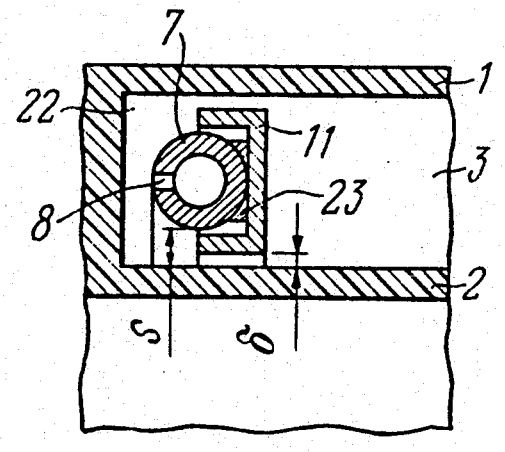
FIG. 9 is a modified form of the anode with a baffle plate insulated from its walls.

The use of the herein proposed accelerator for production processes, such as for machining workpiece surfaces, is associated with a problem of ensuring uniform surface treatment. This problem can be partially solved by using the acceleration passage 3 (FIG. 6) having an elongated cross section, such as by fashioning it as two semicircular and two rectilinear portions 18 and 19. In this case distribution of the longitudinal component $j_z$ of the current density in this direction is levelled out whereby the movement of the workpiece across the above direction will result in more uniform machining. However, such a construction of the acceleration passage 3 overcomplicates fabrication of the anode 7 (FIG. 1). A reasonable way out is the use of tubular anode 7 (FIGS. 7 to 9). Penetration of discharge to the interior of anode 7 can be made less likely thanks to positioning baffle plates 11 close to the wall of anode 7 facing toward the outlet section of the discharge chamber and providing outlet passages 8 in its opposite wall. It also stands to reason that for providing a sheilding effect the cross sectional dimensions of baffle plates 11 must exceed the cross section of the rest of the anode 7, i.e., the distances between the cylindrical elements 1, 2 and nearest surfaces of the baffle plates 11 should preferably be smaller than the corresponding distances between the walls of anode 7 and said cylindrical elements 1, 2. The aforedescribed arrangement is advantageous in that it prevents direct penetration of ions from the anodic plasma to the interior of the anode 7, whereas adequate gas distribution is attained thanks to the formation of an additional gas distribution cavity 22 between the housing of the discharge chamber and anode 7.

When it is necessary to reduce the flow of impurities entering the machining zone 25 of the accelerator (FIG. 10) and from the side walls of the vacuum chambers to which ions from the peripheral portion of the flow fall, it is preferable to use accelerators with membranes 24. Preferably, the membrane 24 has to be fashioned so that material being sputtering therefrom would not enter the machining zone 25 and would not affect the quality of machining. In addition, it is desirable that penetration of this material would not affect the performance characteristics of the accelerator, particularly, deposition of this material should not affect functioning of the baffle plates 11. As atoms of the material move along a straight path, they do not influence operation, if a straight line drawn from any point of surface 27 of the membrane 24 facing the discharge chamber toward any point at the surface of baffle plate 11 facing the outlet section of the discharge chamber, or toward any point in the clearance between the baffle plate 11 and portion of the wall of anode 7 at the location of the outlet passage 8 intersects the wall of the outer cylindrical element 1. Therewith, material being sputtering from the surface of the baffle plate 23 and tending to fall onto the baffle plates 11 and enter the clearance between the baffle plates 11 and wall of the anode 7 will be deposited at the outside of the outer cylindrical element 1 and will not affect normal functioning of the baffle plate 11.

We claim:

1. A plasma accelerator with closed electron drift comprising a discharge chamber having an annular acceleration passage (3) open at the side of an outlet section of the discharge chamber, a hollow anode (7) secured in the acceleration passage (3) and communicating therewith by way of at least one outlet passage (8), and communicating with a gas feeding system by way of at least one inlet passage (9), a magnetic system (4) for inducing a magnetic field in the acceleration passage (3), and a cathode (10) positioned outside the discharge chamber in close proximity to its outlet section, CHARACTERIZED in that the outlet passage (8) is curved, and a straight line segment originating from any point of the hollow interior of the anode (7) to any point of the acceleration passage (3) intersects at least once a wall of the anode (7).

2. A plasma accelerator with closed electron drift as claimed in claim 1, further CHARACTERIZED in that the anode (7) is provided with at least one baffle plate (11) secured in the acceleration passage (3) with a clearance relative to a side of the anode (7), the baffle plate (11) having a side facing the side at the anode (7), the anode (7) and baffle plate (11) being arranged so that the surfaces of their sides facing each other have flat parallel portions, whereas the outlet passage (8) having a hole inside is defined by said distance between the flat parallel portions of the anode (7) and baffle plate (11) and wherein the minimum distance ($\Delta r$) from an axis of the hole perpendicular to the surface of the flat portion of the side of the anode (7) to edge (13) of the flat portion of the side of the baffle plate (11) and the distance ($\delta_1$) between the flat portions of the side of the anode (7) and the baffle plate (11) meet the following relationship:

$$\Delta r \geqq d \frac{\delta_1 + \frac{\delta_2}{2}}{\delta_2},$$

where d is the diameter of the hole in the outlet passage (8), and $\delta_2$ is the thickness of the side of the anode (7) at the location of the hole.

3. A plasma accelerator with closed electron drift comprising a discharge chamber having an annular acceleration passage (3) open at the side of an outlet section of the discharge chamber, a hollow anode (7) secured in the acceleration passage (3) and communicating therewith by way of at least one outlet passage (8), and communicating with a gas feeding system by way of at least one inlet passage (9), a magnetic system (4) for inducing a magnetic field in the acceleration passage (3), and a cathode (10) positioned outside the discharge chamber in close proximity to its outlet section, CHARACTERIZED in that the anode (7) is provided with at least one baffle plate (11) positioned in the acceleration passage (3) of the discharge chamber in close proximity to the wall of the anode (7) facing the outlet section of the discharge chamber, whereas the outlet passage (8) is provided in the opposite wall of the anode (7), and a straight line segment originating from any point of the hollow interior of the anode to any point of the acceleration passage intersects any one of a surface of the baffle plate (11) or wall of the anode.

4. A plasma accelerator with closed electron drift as claimed in claim 2, further CHARACTERIZED in that it is provided with at least one membrane (24) having a hole, positioned after the cathode (10), and arranged so that a straight line (26) drawn from any point of surface (27) of the membrane (24) facing the outlet section of the discharge chamber to any point at the surface of one side of the baffle plate (11) facing the outlet section of the discharge chamber intersects an outer wall of the acceleration passage (3) of the discharge chamber.

5. A plasma accelerator with closed electron drift comprising a discharge chamber having an annular acceleration passage (3) open at the side of an outlet section of the discharge chamber, a hollow anode (7) secured in the acceleration passage (3) and communicating therewith by way of at least one outlet passage (8), and communicating with a gas feeding system by way of at least one inlet passage (9), a magnetic system (4) for inducing a magnetic field in the acceleration passage (3), and a cathode (10) positioned outside the discharge chamber in close proximity to its outlet section, CHARACTERIZED in that the anode (7) is provided with at least one baffle plate (11) positioned in the acceleration passage (3) of the discharge chamber in close proximity to the wall of the anode (7) facing the outlet section of the discharge chamber, whereas the outlet passage (8) is provided in the opposite wall of the anode (7), the shortest distance ($\delta$) from a wall of the acceleration passage (3) to a surface of the baffle plate (11) facing the wall of the acceleration passage being smaller than the shortest distance (s) from the wall of the acceleration passage (3) to a wall of the anode (7).

* * * * *